US011613407B2

(12) United States Patent
Perry

(10) Patent No.: US 11,613,407 B2
(45) Date of Patent: Mar. 28, 2023

(54) NESTED LID CONTAINERS

(71) Applicant: Michael J. Perry, Albany, OR (US)

(72) Inventor: Michael J. Perry, Albany, OR (US)

( * ) Notice: Subject to any disclaimer, the term of this patent is extended or adjusted under 35 U.S.C. 154(b) by 237 days.

(21) Appl. No.: 16/920,591

(22) Filed: Jul. 3, 2020

(65) Prior Publication Data

US 2021/0002028 A1 Jan. 7, 2021

Related U.S. Application Data

(60) Provisional application No. 62/870,630, filed on Jul. 3, 2019.

(51) Int. Cl.

| | |
|---|---|
| ***B65D 25/36*** | (2006.01) |
| ***B65D 21/02*** | (2006.01) |
| ***B65D 81/38*** | (2006.01) |
| ***B65D 43/02*** | (2006.01) |
| ***B65D 25/24*** | (2006.01) |

(52) U.S. Cl.
CPC ..... *B65D 21/0234* (2013.01); *B65D 25/24* (2013.01); *B65D 43/0204* (2013.01); *B65D 43/0214* (2013.01); *B65D 81/3813* (2013.01)

(58) Field of Classification Search
CPC ..... B65D 21/0234; B65D 25/24; B65D 43/0204; B65D 43/0214; B65D 81/3813
USPC ..... 220/4.21, 4.22, 4.23, 4.24, 592.2, 810
See application file for complete search history.

(56) References Cited

U.S. PATENT DOCUMENTS

| | | | | |
|---|---|---|---|---|
| 4,081,646 A * | 3/1978 | Goltsos | ..... | A47G 23/06 426/243 |
| 4,570,818 A * | 2/1986 | Borst | ..... | B65D 43/162 D9/426 |
| 5,743,210 A * | 4/1998 | Lampe | ..... | A01K 5/0114 119/51.5 |

* cited by examiner

*Primary Examiner* — John K Fristoe, Jr.
*Assistant Examiner* — Elizabeth J Volz
(74) *Attorney, Agent, or Firm* — Kunzler Bean & Adamson

(57) ABSTRACT

Apparatuses, systems, and methods are presented for nesting lid containers. An apparatus includes a first container and a second container that includes a bottom, at least one side wall coupled perpendicular to an edge of the bottom and extending from the bottom to an open top to form a container, and a securing element coupled to a side of the bottom opposite the at least one side wall for preventing movement of the container while placed on a surface. A second container is insertable into a first container where at least one side wall of the first container is configured to receive at least one side wall of the second container such that the second container acts as a lid for the first container.

20 Claims, 6 Drawing Sheets

NESTED LID CONTAINERS

CROSS-REFERENCE TO RELATED APPLICATION

This application claims the benefit of U.S. Provisional Patent Application No. 62/870,630 entitled "SUCTIONING NESTED LID CONTAINERS" and filed on Jul. 3, 2019, for Michael J. Perry, which is incorporated herein by reference.

FIELD

The subject matter of the present disclosure relates generally to container and more particularly to nesting lid containers that can be secured to a surface.

BACKGROUND

Containers such as bowls, trays, plates, cups, or the like are typically not securable to a surface such as a tabletop. Furthermore, these items are typically larger items that take up space in a cabinet, on a shelf, or the like.

SUMMARY

From the foregoing discussion, it should be apparent that a need exists for containers that overcome the difficulties that are associated with conventional containers. Beneficially, such an apparatus would improve the ease, efficiency, and effectiveness of a container, or the like.

The subject matter of the present application has been developed in response to the present state of the art, and in particular, in response to the problems and needs in the art that have not yet been fully solved by currently available user restraints. Accordingly, the present disclosure has been developed to provide a container apparatus that overcomes many or all of the above-discussed shortcomings in the art.

Disclosed herein is one embodiment of an apparatus for nested lid containers. An apparatus, in one embodiment, includes a first container and a second container that includes a bottom, at least one side wall coupled perpendicular to an edge of the bottom and extending from the bottom to an open top to form a container, and a securing element coupled to a side of the bottom opposite the at least one side wall for preventing movement of the container while placed on a surface.

A second container, in certain embodiments, is insertable into a first container where at least one side wall of the first container is configured to receive at least one side wall of the second container such that the second container acts as a lid for the first container.

In certain embodiments, the apparatus includes a flexible member that is configured to permanently connect first and second containers to one another. In some embodiments, at least one of first and second containers is made of insulating materials.

In certain embodiments, a securing element comprises a suction cup. In some embodiments, a suction cup generally covers an entire surface of a bottom of a container. In various embodiments, a suction cup is one of a plurality of suction cups coupled to a bottom surface of a container.

In one embodiment, a securing element comprises a rubber footing that grips a surface. In various embodiments, at least one of first and second containers comprises different sections within the container defined by one or more interior walls. In further embodiments, a second container is secured within a first container by a friction fit to create a seal that is substantially airtight.

In one embodiment, a second container is secured within a first container by a snap fit. In some embodiments, first and second containers comprise a single side wall that defines the containers such that the first and second containers have rounded shapes. In various embodiments, first and second containers comprise a plurality of side walls that define the containers such that the first and second containers have angular shapes.

In one embodiment, first and second containers each have an overall height within a range of 30-40 millimeters. In some embodiments, a first container has an overall height of 35.3 millimeters and a second container has an overall height of 30.5 millimeters.

In various embodiments, container portions of each of the first and second containers have a depth within a range of 20-30 millimeters. In one embodiment, a container portion of a first container has a depth of 27.3 millimeters and a container portion of a second container has a depth of 20.5 millimeters.

In one embodiment, an overall height of an apparatus when a second container is inserted into a first container is within a range of 45-50 millimeters. In certain embodiments, an apparatus has an overall height of 48.3 millimeters.

Disclosed herein is one embodiment of a method for nested lid containers. In one embodiment, a method includes aligning a first container with a corresponding second container such that container portions of each of the first and second containers face each other. In certain embodiments, each container includes a bottom, at least one side wall coupled perpendicular to an edge of the bottom and extending from the bottom to an open top to form a container, and a securing element coupled to a side of the bottom opposite the at least one side wall to prevent movement of the container while placed on a surface.

A method, in further embodiments, includes inserting a second container into a first container where at least one side wall of the first container is configured to receive at least one side wall of the second container. In various embodiments, a method includes applying pressure to one or more of a first container and a second container to secure the second container within the first container such that the second container acts as a lid for the first container.

Disclosed herein is one embodiment of another apparatus for nested lid containers. In one embodiment, an apparatus includes a first container and a second container that includes a bottom, at least one side wall coupled perpendicular to an edge of the bottom and extending from the bottom to an open top to form a container, and a securing element coupled to a side of the bottom opposite the at least one side wall for preventing movement of the container while placed on a surface.

An apparatus, in one embodiment, further includes a flexible member permanently connecting a first container to a second container. In certain embodiments, a second container is insertable into a first container where at least one side wall of the first container is configured to receive at least one side wall of the second container such that the second container acts as a lid for the first container.

Reference throughout this specification to features, advantages, or similar language does not imply that all of the features and advantages that may be realized with the present disclosure should be or are in any single embodiment of the invention. Rather, language referring to the features and advantages is understood to mean that a specific feature, advantage, or characteristic described in connection with an embodiment is included in at least one embodiment of the subject matter disclosed herein. Thus, discussion of the features and advantages, and similar language, throughout this specification may, but do not necessarily, refer to the same embodiment.

Furthermore, the described features, advantages, and characteristics of the disclosure may be combined in any suitable manner in one or more embodiments. One skilled in the relevant art will recognize that the subject matter of the present application may be practiced without one or more of the specific features or advantages of a particular embodiment.

In other instances, additional features and advantages may be recognized in certain embodiments that may not be present in all embodiments of the disclosure. Further, in some instances, well-known structures, materials, or operations are not shown or described in detail to avoid obscuring aspects of the subject matter of the present disclosure. These features and advantages of the present disclosure will become more fully apparent from the following description and appended claims or may be learned by the practice of the disclosure as set forth hereinafter.

BRIEF DESCRIPTION OF THE DRAWINGS

In order that the advantages of the subject matter of the present disclosure will be readily understood, a more particular description of the subject matter will be rendered by reference to specific embodiments that are illustrated in the appended drawings. Understanding that these drawings depict only typical embodiments of the subject matter of the present disclosure and are not therefore to be considered to be limiting of its scope, the subject matter will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the subject matter of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the subject matter of the present disclosure, however, absent an express correlation to indicate otherwise, an implementation may be associated with one or more embodiments.

Described herein are containers such as bowls, plates, trays, cups, glasses, and/or the like that can be secured to a relatively flat surface using suction cups or similar securing elements. The containers have at least two sections—one section is the main container and the second section is the lid. The lid section is configured to hold items such as food and also includes a suction cup on its outer or "bottom" side. When the two sections are separate, the containers serve as two places to put food. The lid section can be inserted into the main section to act as a lidded container, as described in more detail below. Other uses for the container may be envisioned in light of the subject matter described herein including using the containers as dog dishes where one container holds dog food and the other container holds water, or the like.

Figure 1A:
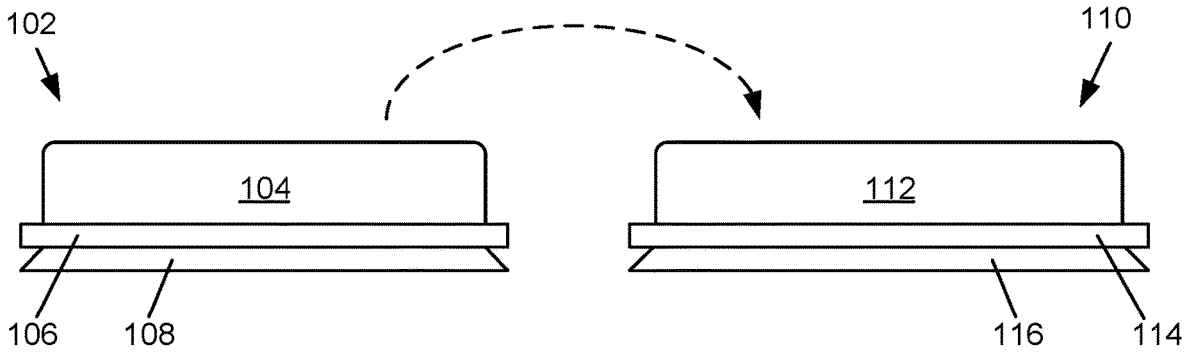
FIG. 1A is a side perspective view of one embodiment of nesting lid containers according to the subject matter disclosed herein.

FIG. 1A is a side perspective view of one embodiment of nesting lid containers according to the subject matter disclosed herein. In one embodiment, the containers include two parts—a lid container 102 and a main container 110. The containers 102, 110 may be interchangeable and are characterized as a lid container 102 and a main container 110 to distinguish the containers 102, 110 from one another herein.

In one embodiment, the containers 102, 110 each include a bottom 106, 114 and at least one side wall 104, 112 coupled perpendicular to an edge of the bottom 106, 114 and extending from the bottom 106, 114 to an open top to form a container. Further, in certain embodiments, each container 102, 110 includes a securing element 108, 116 that is coupled to a side of the bottom 106, 114 that is opposite to the at least one side wall 104, 112 to prevent movement of the container 102, 110 while it is placed on a surface, e.g., a table.

In one embodiment, the lid container 102 and the main container 110 each have an overall height within a range of 30-40 millimeters. The overall height of the containers 102, 110 being the height from the bottom of the securing element 108, 116 to the top of the sidewall 104, 112. In certain embodiments, the lid container 102 has an overall height of 30.5 millimeters, and the main container 110 has an overall height of 35.3 millimeters.

In one embodiment, the container portion (e.g., the portion of the container 102, 110 bounded by the bottom 106, 114 and the sidewall 104, 112 of the container 102, 110 where items, e.g., food is placed) of the lid container 102 and the main container 110 has a depth within a range of 20-30 millimeters. In certain embodiments, the container portion of the lid container 102 has a depth of 20.5 millimeters and the container portion of the main container 110 has a depth of 27.3 millimeters.

In one embodiment, when the lid container 102 is inserted into the main container 110, the containers 102, 110 together or combined have an overall height within the range of 45-50 millimeters, where the overall height is measured from the bottom of the securing elements 116 of the main container 110 to the top of the securing member 108 of the lid container 102. In one embodiment, when the lid container 102 is inserted into the main container 110, the containers 102, 110 together or combined have an overall height of 48.3 millimeters.

In one embodiment, the securing element 108, 116 for the containers 102, 110 may include a suction-type element such as a suction cup. As used herein, a suction cup, also known as a sucker, may refer to a device or object that uses the negative fluid pressure of air or water to adhere to nonporous surfaces, creating a partial vacuum. So, in one embodiment, a user may press on the containers 102, 110 when the suction cups 108, 116 are facing the surface to apply pressure and create a vacuum between the suction cup 108, 116 and the surface such that the suction cups 108, 116 adhere to the surface.

In further embodiments, the securing element 108, 116 may include rubber footings that grip the surface while the containers 102, 110 are placed on the surface. Any number and configuration of rubber footings may be used on the bottom of the containers 102, 110 such that the rubber footings "grip" or "stick" to the surface while the containers 102, 110 are placed on the surface. In one embodiment, the securing element 108 includes a non-slip surface coating such as a rubber, latex, vinyl polymer, or the like, that is applied or coupled directly to the bottom surface of the containers 102, 110.

Figure 5A:
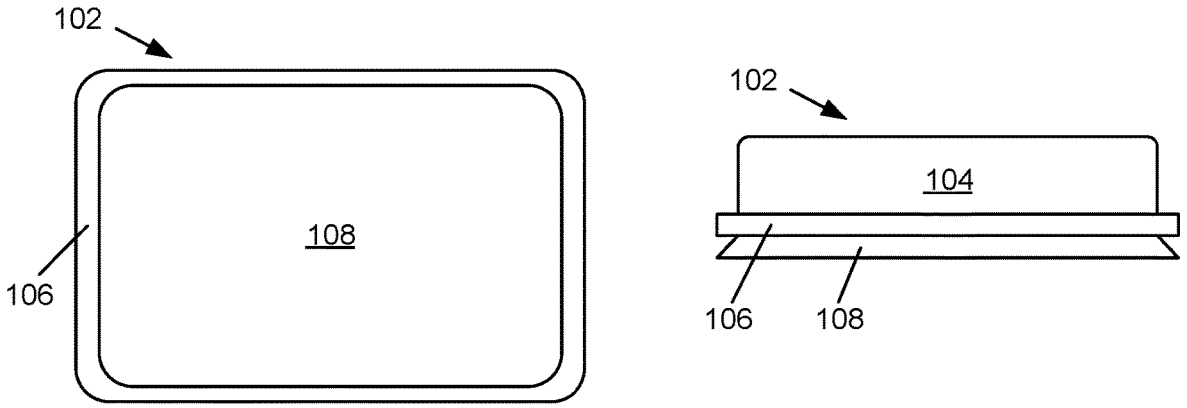
FIG. 5A is a bottom view and a perspective side view of one embodiment of a nesting lid container according to the subject matter disclosed herein.
Figure 5B:
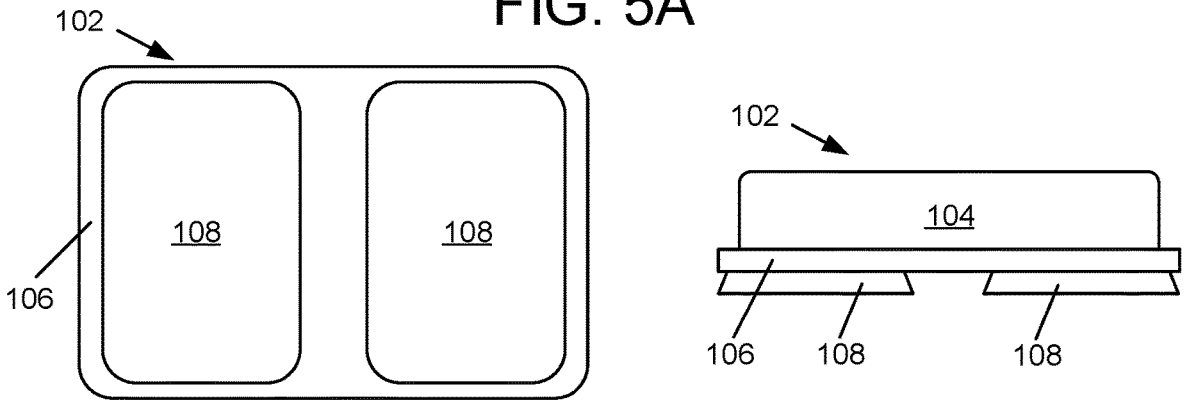
FIG. 5B is a bottom view and a perspective side view of another embodiment of a nesting lid container according to the subject matter disclosed herein.
Figure 5C:
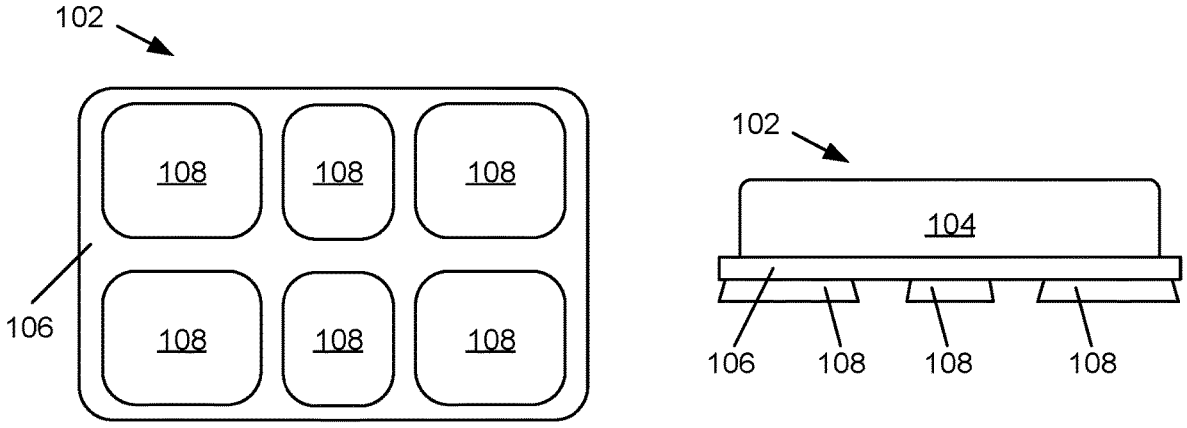
FIG. 5C is a bottom view and a perspective side view of yet another embodiment of a nesting lid container according to the subject matter disclosed herein.

In certain embodiments, one or more securing elements 108, 116 may be included on the bottom surface of the containers 102, 110, as illustrated in FIGS. 5A-5C. FIGS. 5A-5C show perspective bottom and side views of different configurations and numbers of securing elements 108, 116 for a container 102, 110. As shown in FIG. 5A, a single securing element, e.g., a suction cup, a rubber grip/surface, or the like, may be attached to the bottom 106, 114 of a container 102, 110 for securing the container 102, 110 to a surface. As shown in FIG. 5A, the securing element generally covers an entire surface of the bottom 106, 114 of the container 102, 110.

FIG. 5B shows a configuration of securing elements 108 that includes two securing elements on the bottom 106, 114 of a container 102, 110. And FIG. 5C shows a configuration with six different securing elements 108, 116 on the bottom 106, 114 of container 102, 110. One of skill in the art will recognize other configurations and numbers of securing elements 108, 116 that may be used with the containers 102, 110 described herein in light of this disclosure.

Figure 1B:
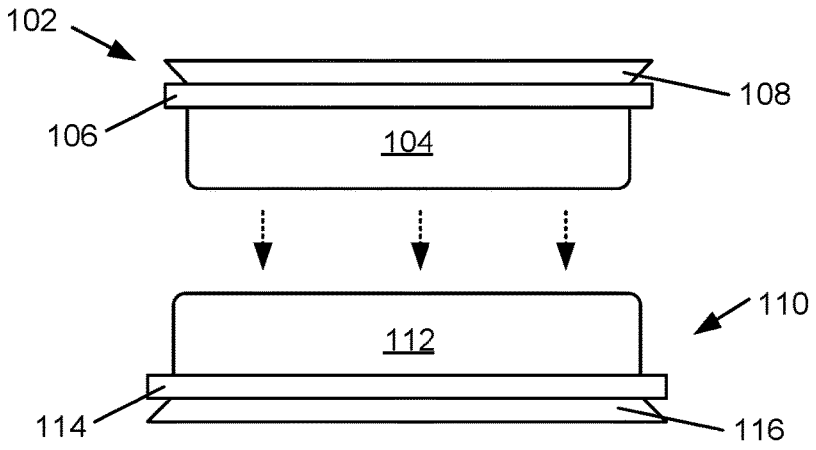
FIG. 1B is a side perspective view of one embodiment of the nesting lid containers of FIG. 1A according to the subject matter disclosed herein.

Referring to FIG. 1B, in one embodiment, the lid container 102 is insertable into the main container 112. FIG. 1B is a side perspective view of one embodiment of the nesting lid containers of FIG. 1A where the lid container 102 is positioned above the main container 110 for insertion into the main container 110.

In such an embodiment, the sidewall(s) 104, 112 of the containers 102, 110, which form the container portion of the containers 102, 110 are designed such that one container 102, 110 is configured to receive the other container 102, 110. For instance, as shown in FIG. 1B, the lid container 102 has a container portion that is formed by the sidewall 104 that is smaller than the container portion formed by the sidewall 112 of the main container 110 such that the lid container 102 can be inserted into and secured in the main container 110. Alternatively, the lid container 102 may have a container portion that is formed by the sidewall 104 that is larger than the container portion that is formed by the sidewall 112 of the main container 110 such that the main container 110 is insertable into the lid container 102.

Figure 1C:
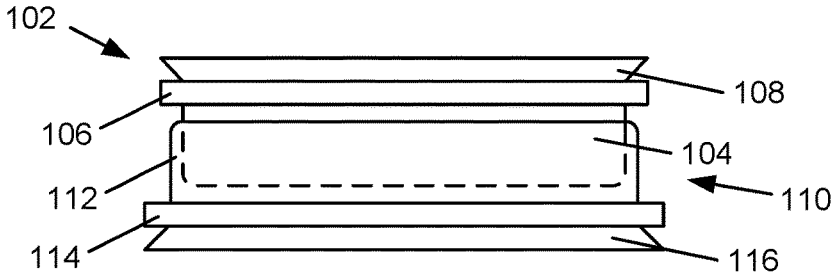
FIG. 1C is a side perspective view of one embodiment of the nesting lid containers of FIGS. 1A and 1B according to the subject matter disclosed herein.

FIG. 1C is a side perspective view of one embodiment of the nesting lid containers of FIGS. 1A and 1B. In FIG. 1C, the lid container 102 is fully inserted into the main container 110 such that the lid container 102 acts as a lid for any items or objects, e.g., food placed within the main container 110. In certain embodiments, the lid container 102 may be secured within the main container 110 by a friction fit, a.k.a., an interference fit where the lid container 102 and the main container 110 are fastened by friction after the two containers are pushed together.

In further embodiments, the lid container 102 may be secured within the main container 110 by a snap or clip fit. In such an embodiment, the lid container 102 may have one or more protruding members (not shown) and the main container 110 may have one or more corresponding receiving members (not shown) for the protruding members such that when the lid container 102 is inserted and pushed into the main container 110, the protruding members insert into the receiving members to hold the lid container 102 in place. The lid container 102 may be removed by pulling the lid container 102 and the main container 110 apart with enough force to release the protruding members from the receiving members.

In further embodiments, the lid container 102 may be secured within the main container 110 by screwing the lid container 102 into the main container 110. In such an embodiment, the lid container 102 may include helical grooves or threads on the outside surface of the sidewall 104 and the main container 110 may include corresponding helical grooves or threads on the inside surface of the sidewall 112 such that the lid container 102 can be screwed into the main container 110 and securely hold the lid container 102 inside the main container 110.

In some embodiments, when the lid container 102 is inserted and secured within the main container 110 (e.g., by friction fit, snap fit, screw fit, or the like), an airtight, hermetic seal is created to prevent air from getting into the containers 102, 110 and to prevent leaks from items within the containers 102, 110.

In one embodiment, the sidewalls 104, 112 and the bottoms 106, 114 of the lid container 102 and the main container 110 is made of plastic, metal (e.g., aluminum), and/or the like. In some embodiments, at least a portion of the lid container 102 and/or the main container 110 includes insulating material for keeping items within the containers cool or warm. The insulating material may include a polyurethane material. The polyurethane material may be located within the sidewall 104, 112 (e.g., if the sidewall 104, 112 and/or bottom 106, 114 is made of aluminum, a polyurethane foam may be injected in between two walls of the sidewall 104, 112 and the bottom 106, 114).

Figure 2A:
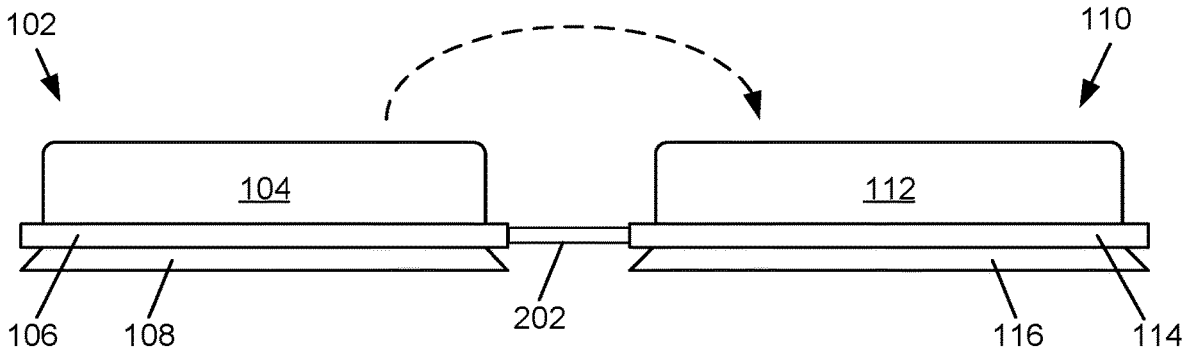
FIG. 2A is a side perspective view of another embodiment of nesting lid containers according to the subject matter disclosed herein.
Figure 2B:
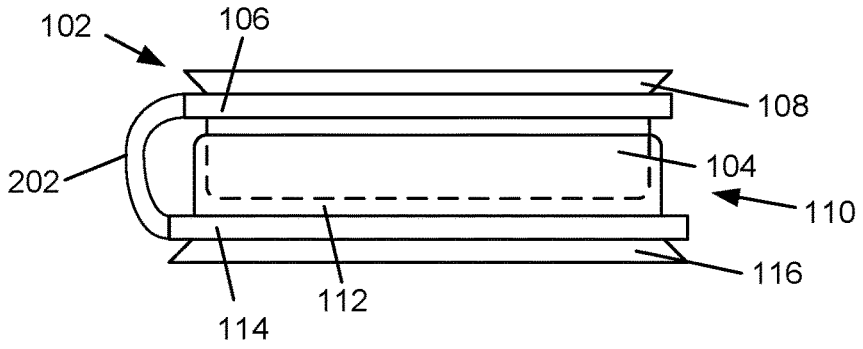
FIG. 2B is a side perspective view of one embodiment of nesting lid containers of FIG. 2A according to the subject matter disclosed herein.

FIG. 2A is a side perspective view of another embodiment of nesting lid containers according to the subject matter disclosed herein. In one embodiment, the containers 102, 110 may be permanently or selectively coupled to one another by a flexible member 202. The flexible member 202 may be made of a flexible material such that it can bend when the lid container 102 is inserted into the main container 110, as illustrated in FIG. 2B. The flexible material may include rubber or a flexible plastic or metal. The flexible member 202 may be a flexible strip of material, a chain, a strap, and/or the like.

In one embodiment, the flexible member 202 may be permanently attached to one or both of the lid container 102 and the main container 110. For instance, the flexible member 202 may be formed as part of the bottom 106, 114 or sidewall 104, 112 of the containers 102, 110 when the containers 102, 110 are manufactured. In further embodiments, the flexible member 202 can be selectively coupled and removed from one or both of the containers 102, 110. For instance, the flexible member 202 may be coupled to the lid container 102 and the main container 110 using snaps, buttons, clips, and/or the like. In this manner, the flexible member 202 helps keep the containers 102, 110 together to prevent losing or misplacing one of the containers 102, 110.

Figure 3:
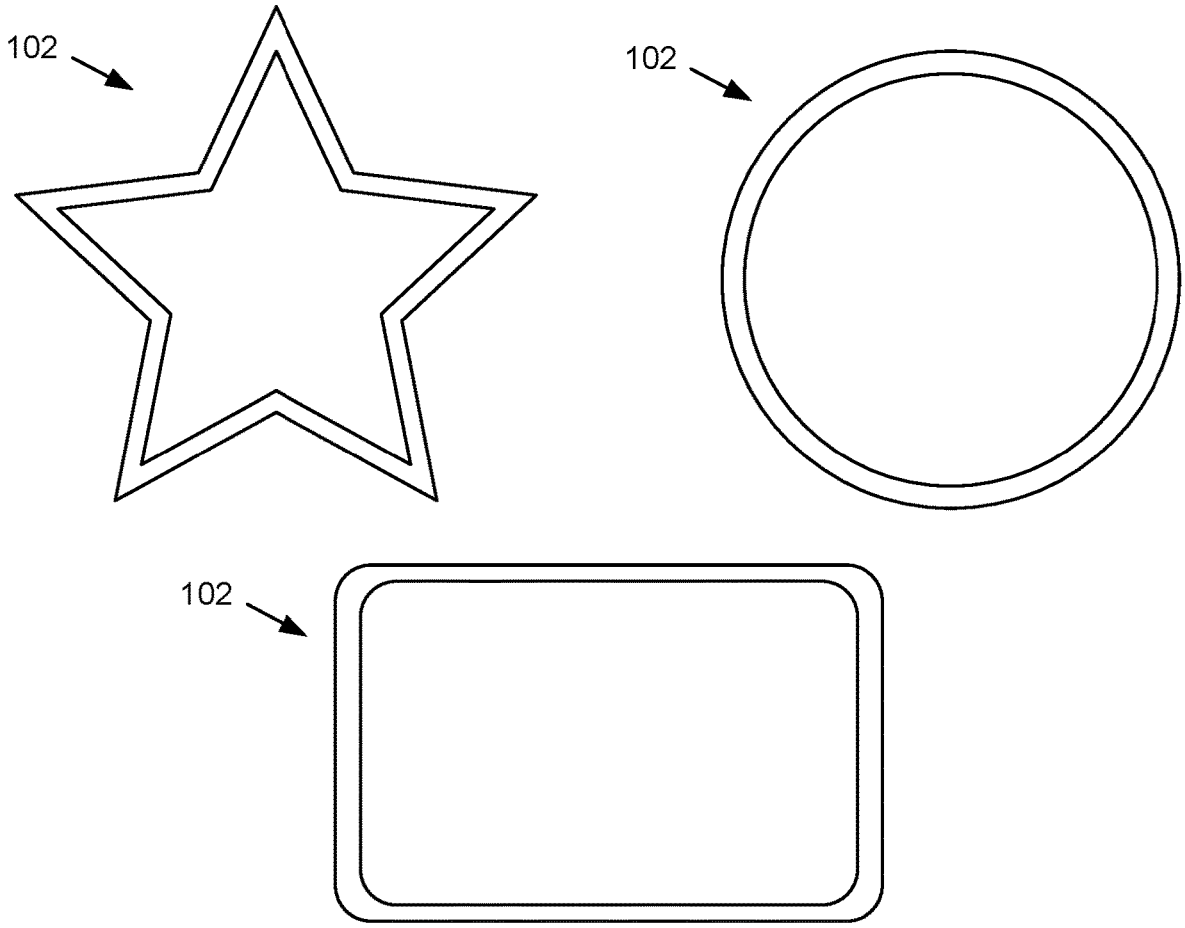
FIG. 3 is a top view perspective of various designs of nesting lid containers according to the subject matter disclosed herein.

FIG. 3 is a top view perspective of various designs of nesting lid containers according to the subject matter disclosed herein. The containers 102, 110 may have various designs for both the lid container 102 and the main container 110. The design of the lid container 102 corresponds to the design of the main container 110 such that the lid container 102 can be inserted into the main container 110.

In one embodiment, the lid container 102 and the main container 110 comprise a design of a single sidewall 104, 112 that defines the containers 102, 110 such that the lid container 102 and the main container 110 have rounded shapes, e.g., circle, oval, or the like. In further embodiments, the lid container 102 and the main container 110 comprise a design of multiple sidewalls 104, 112 that defines the containers 102, 110 such that the lid container 102 and the main container 110 have angular shapes, e.g., square, rectangle, star, diamond, or the like.

As shown in FIG. 3, the containers 102, 110 may have various designs such as a star design, a circle design, an oval design, a square design, a rectangular design, and/or the like. Other designs may mimic objects such as balls (e.g., basketball, football, or the like), characters (e.g., Mickey Mouse, Ironman, or the like), animals, cars, and/or the like.

Figure 4:
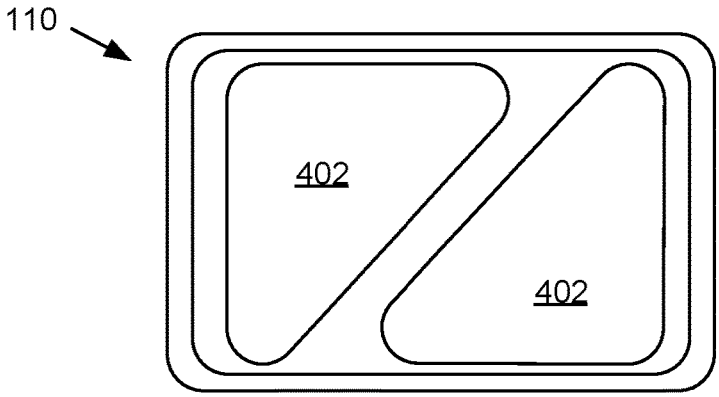
FIG. 4 is a top view perspective of an interior of one embodiment of a nesting lid container according to the subject matter disclosed herein.

FIG. 4 is a top view perspective of an interior of one embodiment of a nesting lid container according to the subject matter disclosed herein. In the depicted embodiment, the lid container 102 and/or main container 110 may include different sections 402 for dividing the items stored in the containers 102, 110. If both the lid container 102 and the main container 110 include different sections 402, the lid container's sections 402 may be configured, e.g., shaped and sized, to be inserted into the corresponding sections 402 of the main container 110 when the lid container 102 is inserted into the main container 110. The different sections 402 may have different shapes, sizes, or the like, and any number of sections may be included in the containers 102, 110 (the two sections 402 shown in FIG. 4 are only one example embodiment.

FIGS. 5A-5C depict various example configurations of the securing member(s), e.g., suction cups, on the bottom of the containers 102, 110, as explained in detail above with reference to FIGS. 1A-1C. FIGS. 5A-5C also show the perspective view of the various example configurations, as explained in detail above with reference to FIGS. 1A-1C.

Figure 6:
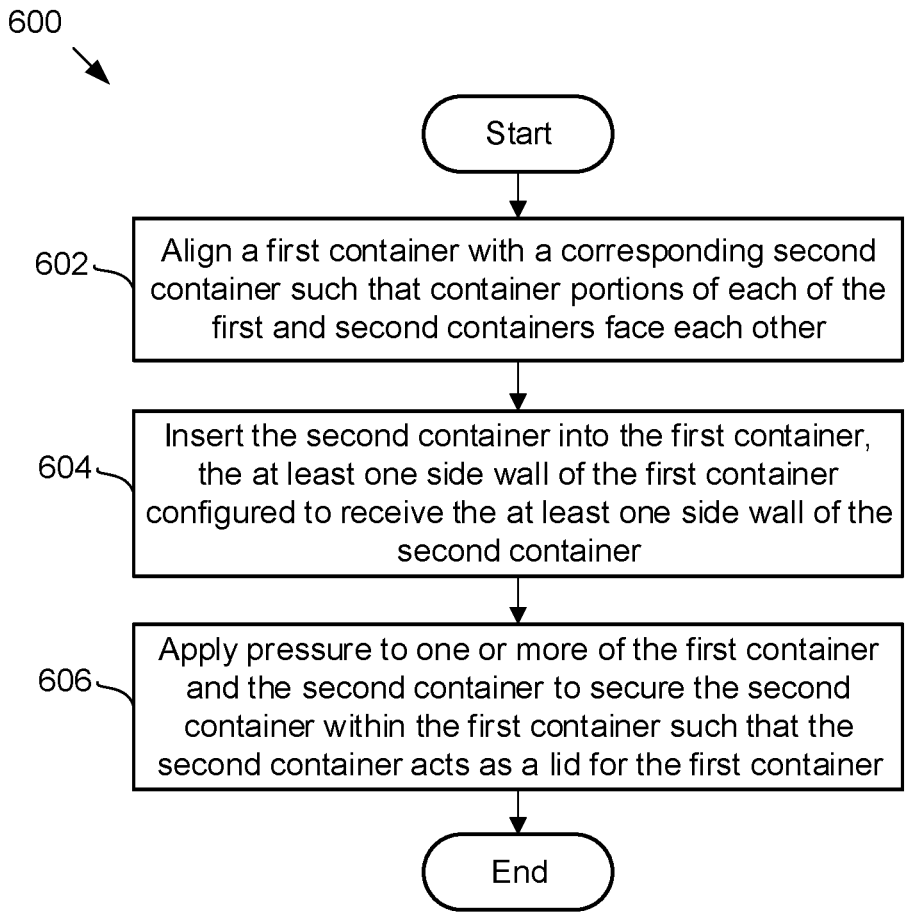
FIG. 6 is a schematic flow chart diagram of one embodiment of a method for nesting lid containers according to the subject matter disclosed herein.

FIG. 6 is a schematic flow chart diagram of one embodiment of a method 600 for nesting lid containers according to the subject matter disclosed herein. In one embodiment, the method 600 begins and aligns 602 a first container, e.g., main container 110 with a corresponding second container, e.g., lid container 102 such that container portions of each of the containers 102, 110 face each other.

In further embodiments, the method 600 includes inserting 604 the second container 102 into the first container 110 where the at least one side wall of the first container 110 is configured to receive the at least one side wall of the second container 102. In certain embodiments, the method 600 includes applying 606 pressure to one or more of the first container 110 and the second container 102 to secure the second container 102 within the first container 110 such that the second container 102 acts as a lid for the first container 110, and the method 600 ends.

Figure 7:
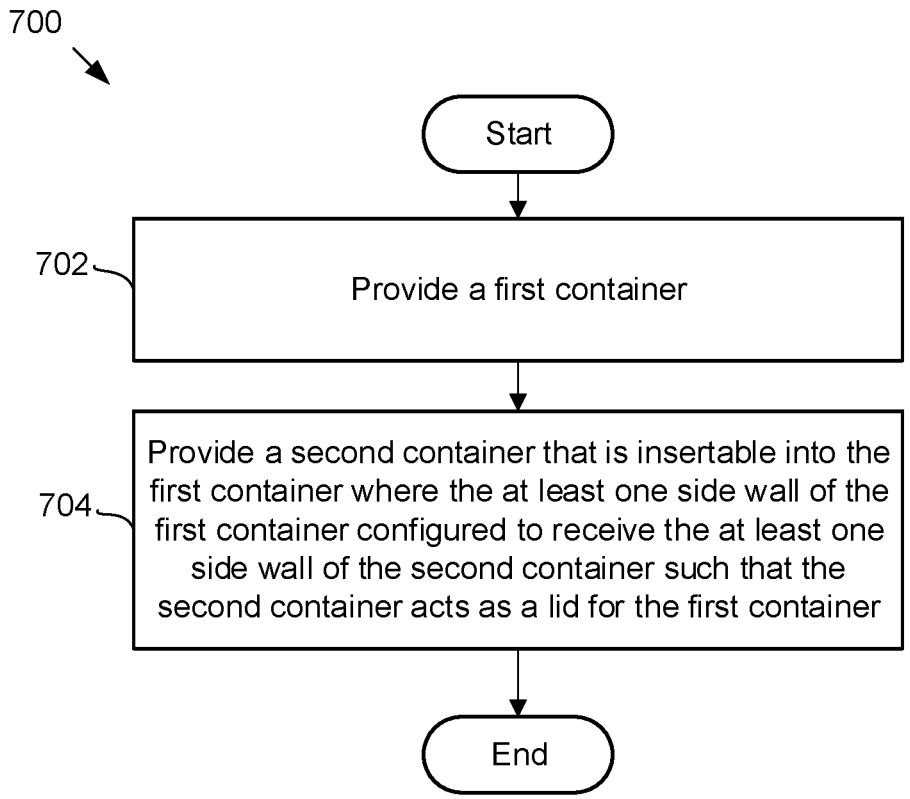
FIG. 7 is a schematic flow chart diagram of one embodiment of another method for nesting lid containers according to the subject matter disclosed herein.

FIG. 7 is a schematic flow chart diagram of one embodiment of a method 700 for nesting lid containers according to the subject matter disclosed herein. In one embodiment, the method 700 begins and provides 702 a first container, e.g., main container 110. The first container 110 includes a bottom 114, at least one side wall 112 coupled perpendicular to an edge of the bottom 114 and extending from the bottom 114 to an open top to form a container, and a securing element 116 coupled to a side of the bottom 114 opposite the at least one side wall 112.

The method 700, in further embodiments, includes providing a second container, e.g., lid container 102. The second container 102 includes a bottom 106, at least one side wall 104 coupled perpendicular to an edge of the bottom 106 and extending from the bottom 106 to an open top to form a container, and a securing element 108 coupled to a side of the bottom 106 opposite the at least one side wall 104. The second container 102 is insertable into the first container 110 where the at least one side wall 112 of the first container 110 is configured to receive the at least one side wall 104 of the second container 102 such that the second container 102 acts as a lid for the first container 110, and the method 700 ends.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. An apparatus comprising:

a first container and a second container, each of the first and second containers comprising:

a bottom;

a side wall coupled perpendicular to an edge of the bottom and extending from the bottom to an open top to form a container, the side wall spanning a perimeter of the edge of the bottom and having a height that is consistent along a length of the side wall; and a securing element coupled to a side of the bottom opposite the at least one side wall, the securing element configured to prevent movement of the container while placed on a surface, wherein the side wall of the second container is insertable into the first container and secured using a friction fit with the side wall of the first container and without use of a secondary securing mechanism such that the second container acts as a lid for the first container.

2. The apparatus of claim 1, further comprising a flexible member configured to permanently connect the first and second containers to one another.

3. The apparatus of claim 1, wherein at least one of the first and second containers is made of insulating materials.

4. The apparatus of claim 1, wherein the securing element comprises a suction cup.

5. The apparatus of claim 4, wherein the suction cup generally covers an entire surface of the bottom.

6. The apparatus of claim 4, wherein the suction cup is one of a plurality of suction cups coupled to the bottom.

7. The apparatus of claim 1, wherein the securing element comprises a rubber footing that grips the surface.

8. The apparatus of claim 1, wherein at least one of the first and second containers comprises different sections within the container defined by one or more interior walls.

9. The apparatus of claim 1, wherein the second container is secured within the first container by a friction fit, the friction fit creating a seal that is substantially airtight.

10. The apparatus of claim 1, wherein the second container is secured within the first container by a snap fit.

11. The apparatus of claim 1, wherein the first and second containers comprise a single side wall that defines the containers such that the first and second containers have rounded shapes.

12. The apparatus of claim 1, wherein the first and second containers comprise a plurality of side walls that define the containers such that the first and second containers have angular shapes.

13. The apparatus of claim 1, wherein the first and second containers each have an overall height within a range of 30-40 centimeters.

14. The apparatus of claim 13, wherein the first container has an overall height of 35.3 centimeters and the second container has an overall height of 30.5 centimeters.

15. The apparatus of claim 1, wherein the container portions of each of the first and second containers have a depth within a range of 20-30 centimeters.

16. The apparatus of claim 15, wherein the container portion of the first container has a depth of 27.3 centimeters and the container portion of the second container has a depth of 20.5 centimeters.

17. The apparatus of claim 1, wherein an overall height of the apparatus when the second container is inserted into the first container is within a range of 45-50 centimeters.

18. The apparatus of claim 17, wherein the apparatus has an overall height of 48.3 centimeters.

19. A method, comprising:

aligning a first container with a corresponding second container such that container portions of each of the first and second containers face each other, each of the first and second containers comprising:

a bottom;

a side wall coupled perpendicular to an edge of the bottom and extending from the bottom to an open top to form a container, the side wall spanning a perimeter of the edge of the bottom and having a height that is consistent along a length of the side wall; and a securing element coupled to a side of the bottom opposite the at least one side wall, the securing element configured to prevent movement of the container while placed on a surface; and inserting the side wall of the second container into the first container; and applying pressure to one or more of the first container and the second container to secure the side wall of the second container within the sidewall of the first container such that the second container acts as a lid for the first container.

20. An apparatus, comprising:

a first container and a second container, each of the first and second containers comprising:

a bottom;

a side wall coupled perpendicular to an edge of the bottom and extending from the bottom to an open top to form a container, the side wall spanning a perimeter of the edge of the bottom and having a height that is consistent along a length of the side wall; and a securing element coupled to a side of the bottom opposite the at least one side wall, the securing element configured to prevent movement of the container while placed on a surface; and a flexible member permanently connecting the first container to the second container, wherein the side wall of the second container is insertable into the first container and secured using a friction fit with the side wall of the first container and without use of a secondary securing mechanism, the side wall of the first container configured to receive the side wall of the second container such that the second container acts as a lid for the first container.

* * * * *